US009004074B2

(12) United States Patent
Nauryzbaev et al.

(10) Patent No.: US 9,004,074 B2
(45) Date of Patent: Apr. 14, 2015

(54) METHOD FOR EXTRACTION OF NICOTINE FROM TOBACCO RAW MATERIAL

(75) Inventors: Michail Kassymovich Nauryzbaev, Almaty (KZ); Dmitri Yurievich Korulkin, Almaty (KZ); Serikbol Tleulessovich Shalghymbaev, Almaty (KZ); Timur Michailovich Nauryzbaev, Almaty (KZ)

(73) Assignee: Al-Farabi Kazakh National University, Almaty (KZ)

( * ) Notice: Subject to any disclaimer, the term of this patent is extended or adjusted under 35 U.S.C. 154(b) by 1703 days.

(21) Appl. No.: 12/012,070

(22) Filed: Jan. 31, 2008

(65) Prior Publication Data

US 2008/0302377 A1 Dec. 11, 2008

(30) Foreign Application Priority Data

Jun. 5, 2007 (KZ) ..... 2007/0762

(51) Int. Cl.
*A24B 15/26* (2006.01)
*A24B 15/24* (2006.01)

(52) U.S. Cl.
CPC ..... *A24B 15/26* (2013.01); *A24B 15/243* (2013.01)

(58) Field of Classification Search
None
See application file for complete search history.

(56) References Cited

U.S. PATENT DOCUMENTS

| | | | | | |
|---|---|---|---|---|---|
| 1,949,012 | A | * | 2/1934 | Frank | 131/298 |
| 3,046,997 | A | * | 7/1962 | Hind | 131/298 |
| 3,894,543 | A | * | 7/1975 | Anderson et al. | 131/275 |
| 4,153,063 | A | | 5/1979 | Roselius et al. | |
| 4,200,113 | A | * | 4/1980 | Schmidt | 131/298 |
| 5,076,293 | A | * | 12/1991 | Kramer | 131/291 |
| 2007/0023058 | A1 | * | 2/2007 | Howell et al. | 131/298 |

FOREIGN PATENT DOCUMENTS

| | | |
|---|---|---|
| CA | 809968 | 4/1969 |
| SU | 240570 | 11/1969 |
| SU | 598543 | 3/1978 |
| SU | 728831 | 4/1980 |

* cited by examiner

*Primary Examiner* — Richard Crispino
*Assistant Examiner* — Phu Nguyen
(74) *Attorney, Agent, or Firm* — Defillo & Associates, Inc.; Evelyn A. Defilló

(57) ABSTRACT

The invention relates to methods of nicotine extraction from tobacco, caporal and tobacco crumb. The proposed method for extraction of nicotine from tobacco, caporal and tobacco crumb implies continuous extraction from raw material with low-boiling solvents at vapor phase followed by solvent stripper and recurrence for further reuse in the process.

7 Claims, No Drawings

METHOD FOR EXTRACTION OF NICOTINE FROM TOBACCO RAW MATERIAL

CROSS REFERENCE TO RELATED APPLICATION

This is a conventional application based on KZ Patent Application No. 2007/0762.1, filed Jun. 5, 2007.

TECHNICAL FIELD OT THE INVENTION AND PRIOR ART

The invention relates to methods of nicotine extraction from tobacco, caporal and tobacco crumb.

There is a known method for extraction of nicotine from tobacco with carbon dioxide, nitrous oxide, argon, sulfur hexafluoride [U.S. Pat. No. 4,153,063, May 8, 1979]. The extraction is performed at temperatures 50-70° C. and pressures up to 1,500 atm. (preferably 70-350 atm.); then temperature and pressure are set lower and nicotine is extracted from the gas flows using sorbents.

For example, for 1 kg of tobacco with adjusted water content of 15% to 25%:

- $CO_2$, 70° C.; 300 atm; the gas:tobacco weight ratio is between 4.9:1 and 6.3:1;
- $CO_2$, 50° C.; 1,000 atm; the gas:tobacco weight ratio is between 7:1 and 9:1;
- Argon, 20° C.; 320 atm; the gas:tobacco weight ratio is between 3.5:1 and 4.5:1;
- $SF_6$, 70° C.; 300 atm; the gas:tobacco weight ratio is between 6:1 and 10:1.

Disadvantages of this method are:

Some hardly available gases, in particular, sulfur hexafluoride, argon and nitrous oxide are required;

Supercritical pressure

In this method, there are indications that it is possible to utilize halogenhydrocarbons, but the conditions are not specified.

There is a known method for extraction of nicotine from tobacco and caporal with nicotine distillation by steam followed by precipitation with phosphotungstic acid: for each 2 g of tobacco, it is required 34-36 g of sodium chloride, 14-15 ml of 8H sodium hydroxide water solution, 8 ml of 5.6% of percipient's solution (phosphotungstic acid) [SU Patent No. 728831, publ. BI No. 15, 1980].

Disadvantages of this method are that it is need a special installation for distillation of quite complex design and using expensive phosphotungstic acid for precipitation—this acid is conventionally used for qualitative analysis at identification of alkaloids, but is not particularly specific for nicotine [Shmuk, A. A., The Chemistry and Technology of Tobacco, Pishchepromizdat, Moscow, 1953, p. 225].

There is a known method for extraction of nicotine from tobacco using organic solvents hardly miscible or immiscible with water and consequent treatment of the extracts by the acid-water solution.

In this method for each kilogram of tobacco, it is required 25-200 l of solvent per hour. Dichlormethane, benzol, cyclohexane, diisopropyl ether, 1,1,1-trichloroethane, trichloroethylene, 1,2-dichlorethane, tetrachloride ethylene are used as solvents [CA Patent No. 809968, 1969-04-08].

For example, tobacco is treated by a flow of organic solvent hardly miscible or immiscible with water and then extraction from the solvent is performed by acid-water solution. In order to assure uniform extraction and achieve economy of the method, extraction of tobacco with organic solvent and extraction from solvent with acid-water solution are realized in continuous process at counter-flow of the two feeds. At that, the contact time for tobacco and organic solvent comprises 45-180 min using a solvent to tobacco ratio of 25-200 l of solvent per 1 kg of tobacco per hour. Acid-water solution is removed at nicotine content from 5% to 25%; removed solution is replaced with the appropriate quantity of clean acid-water solution and extracted tobacco is continuously removed with residual organic solvent in it (in the amount of 1.5-4 l per 1 kg of tobacco); then organic solvent is evaporated and regenerated.

Disadvantages of this method include:

- large consumption of solvents (25-200 l), i.e. the raw material:extractant weight ratio is between 1:10 and 1:100;
- extraction with organic solvent is performed in 2 stages, at pH=2.0 and 2.5 by acid treatment of the extract (using chlorine-hydrogen acid, sulphuric acid or orthophosphoric acid);
- the above-mentioned acids may cause corrosion of the equipment.

SUMMARY OF THE INVENTION

An object of the invention is to provide a method for extraction of nicotine from tobacco and caporal as well as from waste products (from a tobacco crumb).

Another object of the invention is to provide a possibility for processing of primary raw materials and production wastes, a shorter, less expensive and technologically simple nicotine extraction, lower contents of accompanying substances in the target product and elimination of usage of acids.

These objects are achieved by the method for extraction of nicotine from tobacco raw material using extraction treatment of raw material by means of organic solvent and subsequent solvent stripping, but unlike the previously known methods, there are used the low-boiling solvents (petroleum ether, chloroform, methylenchloride) at the raw material:solvent weight ratio of about 1:3; tobacco, caporal, and tobacco crumb (production waste) are used as the raw material, and extraction of nicotine is carried out for around 5 h in vapor phase.

DETAILED DESCRIPTION OF PREFERRED EMBODIMENT OF THE INVENTION

The proposed method makes it possible to reduce the ratio of raw material to solvent, to re-use the solvent stripper at extraction, eliminates need for high pressure, high temperature, acids used in extraction, that improves quality of nicotine, reduces equipment corrosion and, in turn, decreases production cost.

The present invention makes it possible:

- to use easily accessible low-boiling extractants;
- to carry out the one continuous step process during 5 hours with temperatures not exceeding 70° C. and subsequent concentration of extracts at boiling temperatures of extractants (petroleum ether–$T_{boil}$=40-70° C., chloroform–$T_{boil}$=65° C., methylenchloride–$T_{boil}$=40° C. at 760 mm Hg);
- to use any tobacco raw material, tobacco waste and any extraction performance at normal pressure;
- to reduce the raw material:extracant weight ratio to 1:3.

Example 1

A mass of 100 g of crushed tobacco raw material was inserted into the paper cartridge of a Soxhlet extraction apparatus; 300 ml of petroleum ether was placed in a flask (the raw material:solvent weight ratio 1:3) and was refluxed at 40-65° C.

The percent extraction of nicotine at the extraction time of 2 h, 3 h, 4 h, 5 h, and 6 h were respectively 72.5%, 80.7%, 86.6%, 89.2%, and 90.5%.

Example 2

A mass of 100 g of crushed tobacco raw material was inserted into the paper cartridge of a Soxhlet extraction apparatus; 300 ml of petroleum ether was placed in a flask (the raw material:solvent weight ratio 1:3) and was refluxed at 60-65° C.

The percent extraction of nicotine at the extraction time of 2 h, 3 h, 4 h, 5 h, and 6 h were respectively 66.4%, 71.1%, 78.9%, 83.5%, and 84.2%.

Example 3

A mass of 100 g of crushed tobacco raw material was inserted into the paper cartridge of a Soxhlet extraction apparatus; 300 ml of petroleum ether was placed in a flask (the raw material:solvent weight ratio 1:3) and was refluxed at 40° C.

The percent extraction of nicotine at the extraction time of 2 h, 3 h, 4 h, 5 h, and 6 h were respectively 68.9%, 75.3%, 84.2%, 86.8%, and 87.6%.

Therefore, the advantages of the proposed method include:

wider range of nicotine-containing raw materials for commercial processing;

cheaper extraction process due to utilization of cheaper extracants and absence of expensive equipment, of gas extraction at high pressure, of expensive and environmentally hazardous acids (phosphotungstic, hydrochloric, orthophosphoric or sulphuric acids);

lower concentrations of accessory agents in the target product.

We claim:

1. A method for extracting nicotine from a raw tobacco source, the method consisting of:

a one continuous step including extracting a material consisting of a raw tobacco material with an organic solvent, the raw tobacco material is selected from the group consisting of tobacco crumbs, caporal, and tobacco shag, a weight ratio of the raw tobacco material:the organic solvent is 1:3; and stripping the organic solvent at a boiling temperature of the organic solvent;

wherein the organic solvent is a low-boiling solvent selected from the group consisting of chloroform, methylene chloride, and mixture thereof; and wherein 66.4-90.5% of the nicotine is extracted from the raw tobacco material in the one continuous step.

2. The method according to claim 1, wherein the temperature does not exceed 70° C.

3. A method for extracting nicotine from a raw tobacco source, the method consisting of:

a one continuous step including extracting a material consisting of a raw tobacco material with an organic solvent, the raw tobacco material is selected from the group consisting of tobacco crumbs, caporal, and tobacco shag, a weight ratio of the raw tobacco material:the organic solvent is 1:3; and stripping the organic solvent at a boiling temperature of the organic solvent;

wherein the organic solvent is a low-boiling solvent selected from the group consisting of chloroform, methylene chloride, and mixture thereof;

wherein 66.4-90.5% of the nicotine is extracted from the raw tobacco material in the one continuous step; and wherein the one continuous step is performed in a soxhlet extraction apparatus.

4. The method according to claim 3, wherein the one continuous step is performed at 40-65° C. for 2-6 hours and wherein 72.5 to 90.5% of nicotine is extracted from the tobacco raw material in the one continuous step.

5. The method according to claim 3, wherein the one continuous step is performed at 60-65° C. for 2-6 hours and wherein 66.4 to 84.2% of nicotine is extracted from the tobacco raw material in the one continuous step.

6. The method according to claim 3, wherein the one continuous step is performed at 40° C. for 2-6 hours and wherein 68.9 to 87.6% of nicotine is extracted from the tobacco raw material in the one continuous step.

7. A method for extracting nicotine from a tobacco source, the method consisting of:

a one continuous step including extracting a material consisting of a raw tobacco material with an organic solvent, the raw tobacco material is selected from the group consisting of tobacco crumbs, caporal, and tobacco shag, a weight ratio of the raw tobacco material:the organic solvent is 1:3; and stripping the organic solvent at a boiling temperature of the organic solvent at 760 mm Hg;

wherein the organic solvent is a low-boiling solvent selected from the group consisting of chloroform, methylene chloride, and mixture thereof;

wherein the one continuous step was performed at 40-65° C. for 2-6 hours; and wherein 72.5 to 90.5 of nicotine is extracted from the tobacco raw material in the one continuous step.

* * * * *